US007931716B2

(12) United States Patent
Oakham

(10) Patent No.: US 7,931,716 B2
(45) Date of Patent: Apr. 26, 2011

(54) HANDHELD CLEANING APPLIANCE

(75) Inventor: George Francis Paul Oakham, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 79 days.

(21) Appl. No.: 12/307,682

(22) PCT Filed: Jul. 6, 2007

(86) PCT No.: PCT/GB2007/002526

§ 371 (c)(1),
(2), (4) Date: Jul. 28, 2009

(87) PCT Pub. No.: WO2008/009885

PCT Pub. Date: Jan. 24, 2008

(65) Prior Publication Data

US 2009/0308254 A1 Dec. 17, 2009

(30) Foreign Application Priority Data

Jul. 18, 2006 (GB) ..... 0614238.4

(51) Int. Cl.
*B01D 50/00* (2006.01)

(52) U.S. Cl. ..... 55/337; 55/343; 55/345; 55/346; 55/356; 55/422; 55/424; 55/428; 55/467; 55/470; 55/471; 55/472; 55/473; 55/DIG. 3; 55/DIG. 34; 95/1; 95/8; 96/423; 73/25.02; 73/31.02; 73/31.03

(58) Field of Classification Search ..... 55/337, 55/343, 345, 346, 356, 422, 424, 428, 467, 55/470–473, DIG. 3, DIG. 34; 95/8, 1; 96/423; 73/25.02, 31.02, 31.03; 116/268, 283, DIG. 25; 15/319, 339, 347, 352
See application file for complete search history.

(56) References Cited

U.S. PATENT DOCUMENTS 4,245,370 A 1/1981 Baker (Continued)

FOREIGN PATENT DOCUMENTS

EP 0 042 723 12/1981

(Continued)

OTHER PUBLICATIONS

GB Search Report, dated Oct. 11, 2006, directed to counterpart GB Patent Application No. 0614238.4; 1 page.

(Continued)

*Primary Examiner* — Jason M Greene
*Assistant Examiner* — Dung Bui
(74) *Attorney, Agent, or Firm* — Morrison & Foerster LLP

(57) ABSTRACT

A cleaning appliance includes a main body, a filter and an interlock. The main body includes an airflow generator, a separating apparatus separating dirt and dust from an airflow, and a flowpath between the separating apparatus and the airflow generator delimited by a wall. The interlock has a first part located on the filter and a second part located on the main body outside the flowpath, arranged to communicate remotely when the filter is correctly located in the pre-determined position. The interlock is arranged selectively to allow or prevent operation of the airflow generator depending upon the relative separation between the first and second parts. By providing an interlock which has first and second parts which communicate remotely, the second part located on the main body can be isolated from the airflow path so that the second part is not subject to dirt and dust carried by the airflow.

17 Claims, 3 Drawing Sheets

U.S. PATENT DOCUMENTS

| | | | | |
|---|---|---|---|---|
| 5,102,435 | A | 4/1992 | Rau et al. | |
| 6,073,302 | A | 6/2000 | Buscher | |
| 6,170,118 | B1 * | 1/2001 | McIntyre et al. | 15/327.6 |
| 6,569,217 | B1 * | 5/2003 | DeMarco | 55/324 |
| 7,303,613 | B2 * | 12/2007 | Rosenzweig | 96/421 |
| 7,309,365 | B2 * | 12/2007 | Yuasa et al. | 55/283 |
| 7,334,290 | B2 * | 2/2008 | Hawkins et al. | 15/352 |
| 2002/0189048 | A1 | 12/2002 | Maruyama et al. | |
| 2004/0078921 | A1 * | 4/2004 | Yuasa et al. | 15/319 |
| 2004/0261382 | A1 | 12/2004 | Baldinger et al. | |
| 2005/0274094 | A1 * | 12/2005 | DeMarco | 55/356 |
| 2007/0119016 | A1 * | 5/2007 | Drevitson et al. | 15/339 |

FOREIGN PATENT DOCUMENTS

| | | |
|---|---|---|
| GB | 2 320 419 | 6/1998 |
| JP | 2-131732 | 5/1990 |
| JP | 5-184497 | 7/1993 |
| JP | 8-196489 | 8/1996 |
| WO | WO-03-022120 | 3/2003 |

OTHER PUBLICATIONS

International Search Report and Written Opinion, mailed Sep. 26, 2007, directed to counterpart International Patent Application No. PCT/GB2007/002526; 11 pages.

International Preliminary Report on Patentability, mailed Oct. 8, 2008, directed to counterpart International Patent Application No. PCT/ GB2007/002526; 8 pages.

* cited by examiner

HANDHELD CLEANING APPLIANCE

REFERENCE TO RELATED APPLICATIONS

This application is a national stage application under 35 USC 371 of International Application No. PCT/GB2007/002526, filed Jul. 6, 2007, which claims the priority of United Kingdom Application No. 0614238.4, filed Jul. 18, 2006, the contents of which prior applications are incorporated herein by reference.

FIELD OF THE INVENTION

The invention relates to a cleaning appliance. Particularly, but not exclusively, the invention relates to a vacuum cleaner and more particularly to a hand-held vacuum cleaner.

BACKGROUND OF THE INVENTION

Vacuum cleaners are designed to separate dirt and dust from an airflow. Commonly, an airflow generator (for example, a motor and fan unit) generates an airflow which draws dirt- and dust-laden air into the vacuum cleaner through a dirty air inlet. The airflow then passes through a form of separating apparatus such as a porous bag or a cyclonic separator (see, for example, EP 0 042 723) to remove dirt and dust from the airflow.

Irrespective of the type of separating apparatus used, there may be a risk of a small amount of dirt and dust passing through the separating apparatus and being carried to the airflow generator. It is undesirable for dirt and dust particles to pass through the fan of an airflow generator because the fan may become damaged or may operate less efficiently. In order to reduce this problem, some vacuum cleaners include a fine filter in an airflow path between the separating apparatus and the airflow generator (see, for example, GB 2 320 419). This filter is commonly known as a "pre-motor filter" and is used to extract any fine dirt and dust particles remaining in the airflow after it has passed through the separating apparatus.

During normal operation of a vacuum cleaner, fine dirt and dust may be deposited on a pre-motor filter and, after a period of time, it could become blocked. Blockages reduce the efficiency at which a vacuum cleaner operates. Therefore, a pre-motor filter will occasionally need to be replaced or cleaned in order to maintain the performance of the vacuum cleaner. In order to allow cleaning or replacement of the pre-motor filter, it is common for such filters to be removable from a vacuum cleaner.

Once the pre-motor filter has been removed, there is a risk that a user will not replace the pre-motor filter, or will replace it incorrectly. If the vacuum cleaner is operated without the pre-motor filter or with it fitted incorrectly, then there is a risk of the dirt and dust which would normally be captured by the pre-motor filter causing damage to, or failure of, the airflow generator as discussed previously.

Various prior art arrangements address this issue by using a form of interlock to prevent operation of the vacuum cleaner if a filter is not correctly located in the vacuum cleaner. For example, U.S. Pat. No. 5,102,435 discloses a vacuum cleaner including a filter interlock which comprises a projection on the filter and a switch on the vacuum cleaner. The projection engages with the switch when the filter is fitted correctly, allowing the vacuum cleaner to operate. However, when the filter is not fitted correctly, the projection does not engage with the switch and the vacuum cleaner will not operate.

The above arrangement requires contact between two mechanical parts which are located in, or close to, an airflow path. Therefore, there may be a risk that these parts will become clogged with dirt and dust over time, or be prone to mechanical failure. This may prevent the interlock from operating correctly.

SUMMARY OF THE INVENTION

It is an object of the present invention to provide a cleaning appliance having an improved interlock which is able to prevent operation of an airflow generator if a pre-motor filter is missing from, or incorrectly located in, the cleaning appliance. It is a further object of the present invention to provide a cleaning appliance having an interlock which is less susceptible to clogging or blocking, and which is less prone to mechanical failure.

The invention provides a cleaning appliance comprising a main body, a filter and an interlock, the main body including an airflow generator, separating apparatus for separating dirt and dust from an airflow and a flowpath between the separating apparatus and the airflow generator, the flowpath being delimited by a wall, the filter being removably located in a pre-determined position in the flowpath and the interlock having a first part located on the filter and a second part located on the main body, the first and second parts being adapted and arranged to communicate remotely when the filter is correctly located in the predetermined position and the interlock being adapted and arranged selectively to allow or prevent operation of the airflow generator depending upon the relative separation between the first and second parts, wherein the second part is located outside the flowpath.

By providing an interlock having first and second parts which communicate remotely, the second part which is located on the main body can be isolated from the airflow path. This means that the second part will not be subject to dirt and dust in the airflow and will be less likely to become dirty or damaged. The wall delimiting the flowpath protects the second part of the interlock and prevents contamination of the second part by dirt and dust which may be present in the flowpath.

Preferably, the first and second parts are spaced from one another when the filter is correctly located in the pre-determined position. By providing such an arrangement, direct contact between the first and second parts is avoided. This reduces mechanical wear and tear and consequently improves reliability.

Preferably, the interlock is adapted and arranged to prevent operation of the airflow generator when the separation between the first and second parts exceeds a pre-determined distance. This arrangement allows the interlock to operate as a remote switch in which mechanical contact between the two parts is unnecessary.

Preferably, the filter has a longitudinal axis and a transverse axis and the first part is spaced from at least one of the longitudinal and transverse axes. More preferably, the first part is spaced from both the longitudinal axis and the transverse axis. This prevents the airflow generator from operating if the filter is located back-to-front or upside down in the cleaning appliance.

Preferably, the first part includes an emission source and the second part includes a detector. More preferably, the first part includes a passive emission source. By providing such an arrangement, the first part can be a passive element that does not require a power source and can withstand greater wear and tear.

BRIEF DESCRIPTION OF THE DRAWINGS

An embodiment of the invention will now be described with reference to the accompanying drawings, in which.

DETAILED DESCRIPTION OF THE INVENTION

Figure 1:
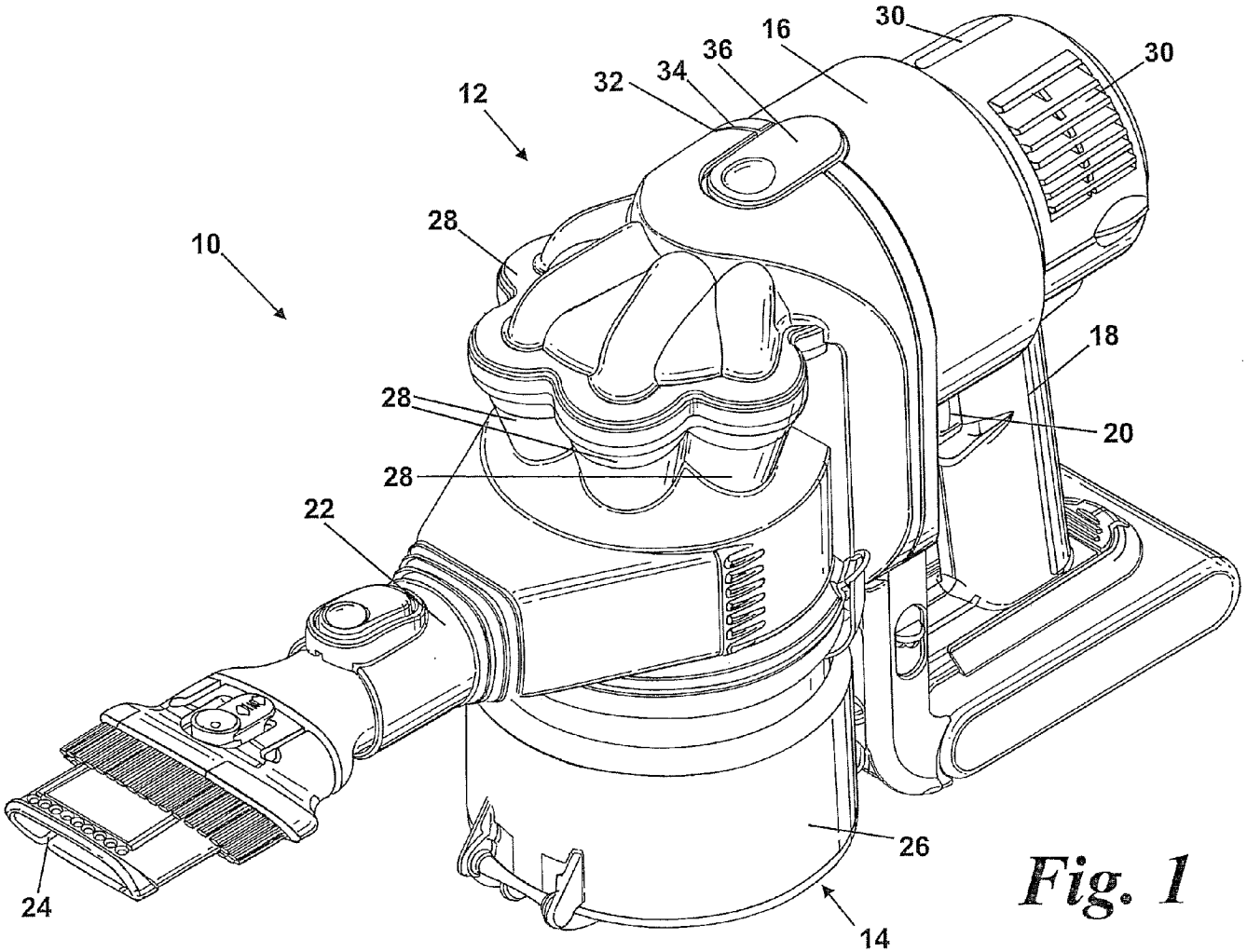
FIG. 1 is an isometric view of a cleaning appliance according to the invention.

FIG. 1 shows a hand-held vacuum cleaner 10. The hand-held vacuum cleaner 10 comprises a main body 12. The main body 12 includes cyclonic separating apparatus 14 which is capable of separating dirt and dust from an airflow, a motor housing 16 and a handgrip 18 for manipulating the hand-held vacuum cleaner 10 in use. The handgrip 18 includes a trigger 20 which is positioned such that it can be manipulated by a user's finger.

The main body 12 further includes a suction conduit 22 which has a suction opening 24 at one end. The suction conduit 22 communicates with the cyclonic separating apparatus 14. The cyclonic separating apparatus 14 comprises an upstream cyclone 26 and a plurality of downstream cyclones 28. A flowpath extends from the suction opening 24, through the suction conduit 22, the cyclonic separating apparatus 14 and the motor housing 16 to a plurality of exhaust vents 30 formed in the motor housing 16.

In FIG. 1, the cyclonic separating apparatus 14 is shown connected to the motor housing 16. The cyclone separating apparatus 14 and the motor housing 16 are connected by complementary first and second lips 32, 34. A catch 36 releasably secures the first and second lips 32, 34 to one another. In order to gain access to a part of the flowpath downstream of the cyclonic separating apparatus 14, these components can be separated from one another. This is shown in FIG. 2.

Figure 2:
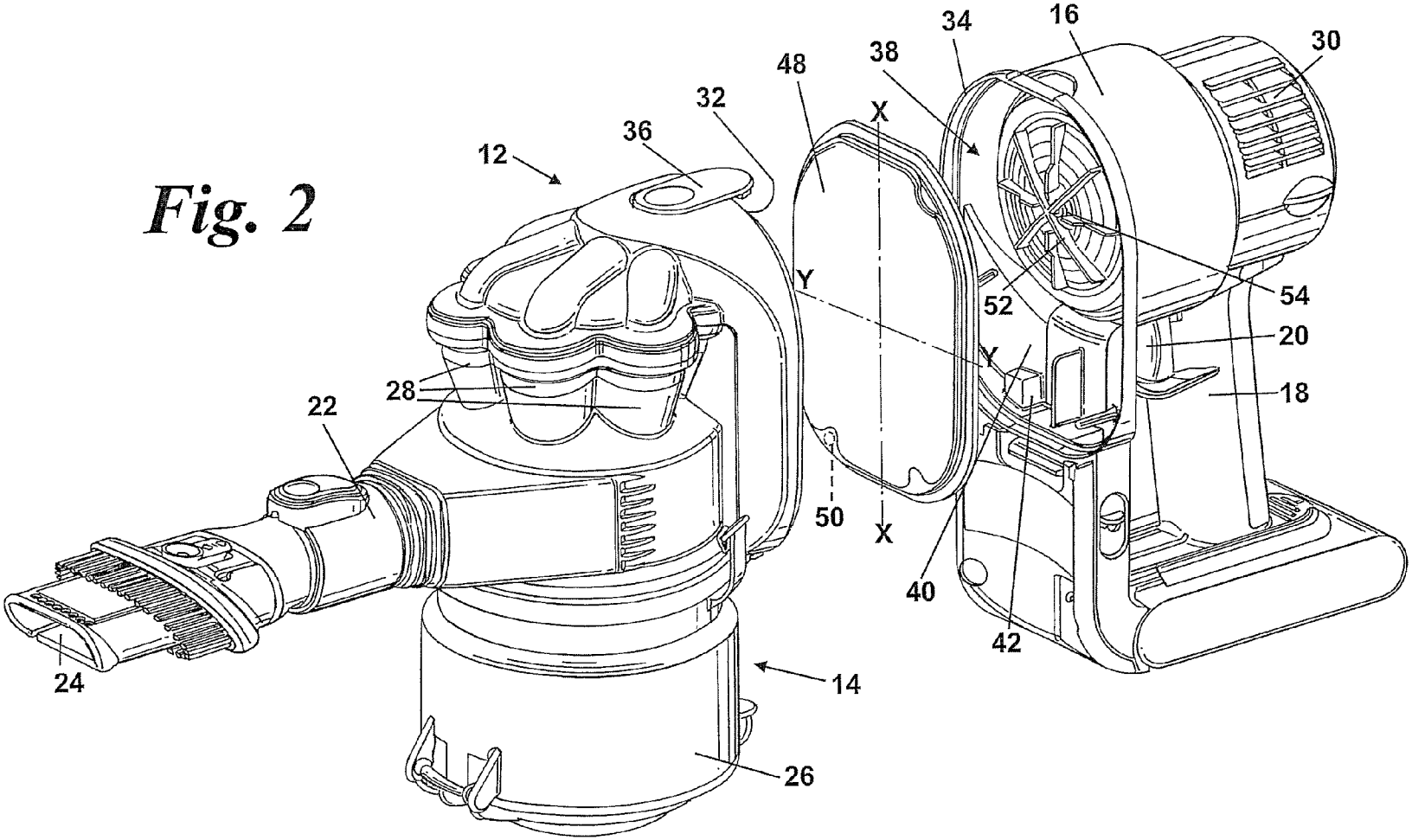
FIG. 2 is an exploded isometric view of the cleaning appliance of FIG. 1.
Figure 3:
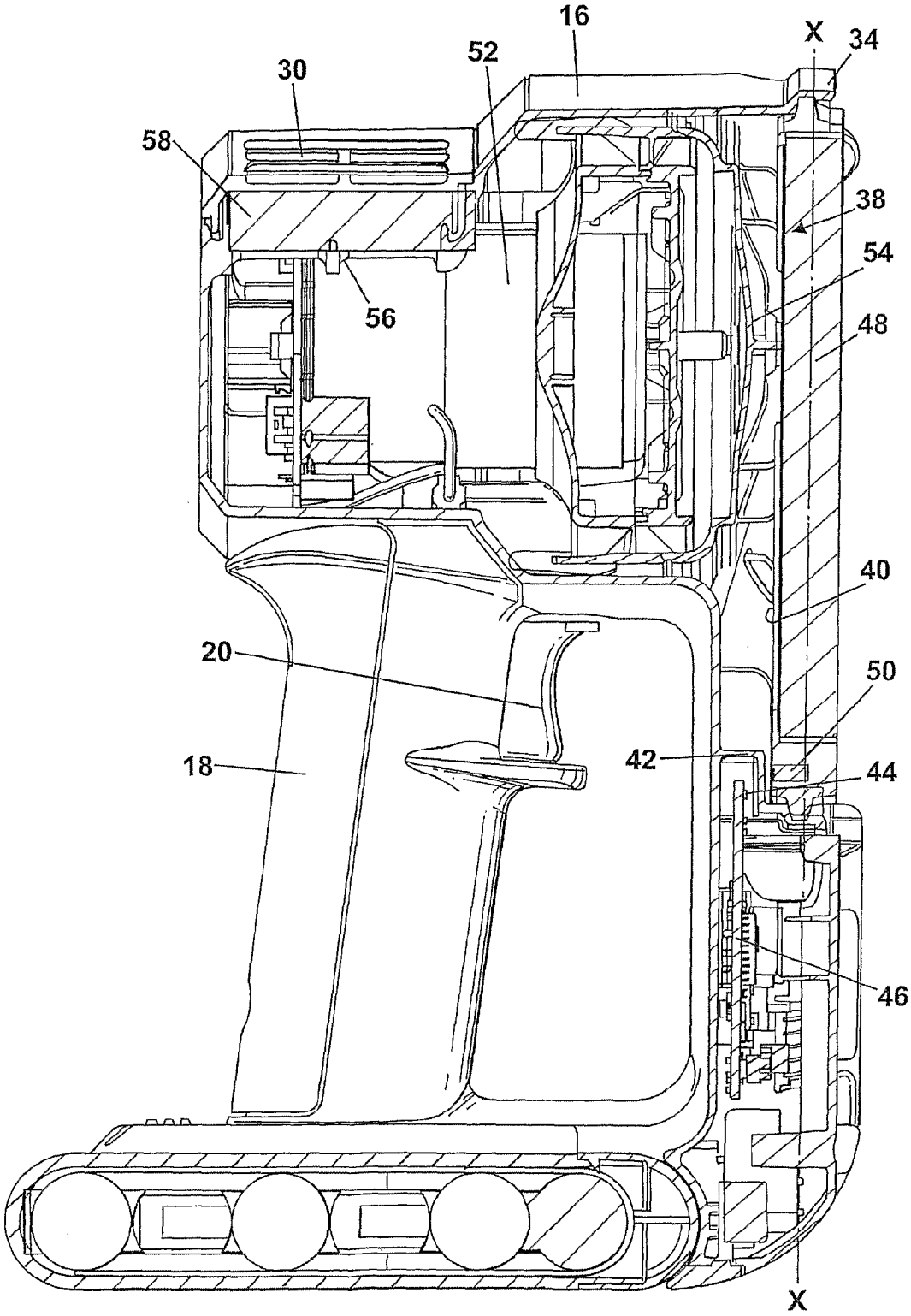
FIG. 3 is section through the cleaning appliance of FIG. 1 showing only the rear part of the cleaning appliance.

FIGS. 2 and 3 show the flowpath downstream of the cyclonic separating apparatus in more detail. A cavity 38 is formed in the main body 12 immediately upstream of the motor housing 16. The cavity 38 is located at a pre-determined position in the flowpath and is delimited by the second lip 34 and a rear wall 40. A part of the rear wall 40 of the cavity 38 forms a raised portion 42 which is located at one side of the cavity 38. A Hall sensor 44 is located in the interior of the raised portion 42. The rear wall 40 is located between the Hall sensor 44 and the cavity 38 so that the Hall sensor 44 is located outside the cavity 38 and therefore outside the flowpath. This is best shown in FIG. 3. The Hall sensor 44 is responsive to the strength of a magnetic field and is arranged to act as a switch. When a magnetic field experienced by the Hall sensor 44 exceeds a pre-determined value, the Hall sensor 44 is arranged to change state. The state of the Hall sensor 44 will again change if a magnetic field experienced by the Hall sensor 44 falls below the pre-determined value. The Hall sensor 44 is connected to an electronic circuit 46 which detects the state of the Hall sensor 44.

A pre-motor filter 48 is removably located in the cavity 38. A magnetic element 50 is located on the pre-motor filter 48 close to one side (see FIG. 3). The magnetic element 50 and the Hall sensor 44 form first and second parts respectively of an interlock and are able to communicate remotely. By this is meant that the two components do not need to be in contact with one another to operate and that they can interact over a distance.

When the pre-motor filter 48 is correctly located in the cavity 38, the magnetic element 50 is spaced from the Hall sensor 44 by a distance which is less than a pre-determined distance. The pre-determined distance is a pre-determined separation between the Hall sensor 44 and the magnetic element 50 beyond which the magnetic field of the magnetic element 50 experienced by the Hall sensor 44 drops below the pre-determined value. The pre-determined distance is variable depending upon the magnetic field strength of the magnetic element 50 and the sensitivity of the Hall sensor 44. In this embodiment, the pre-determined distance is of the order of 5 mm. When the predetermined distance is exceeded, the Hall sensor 44 changes state and this will be detected by the electronic circuit 46.

The pre-motor filter 48 has a longitudinal axis X-X and a transverse axis Y-Y. The magnetic element 50 is spaced from both the longitudinal and transverse axes X-X, Y-Y of the pre-motor filter 48. Further, when the pre-motor filter 48 is correctly located in the cavity 38, the Hall sensor 44 is also spaced from the longitudinal and transverse axes X-X, Y-Y. This is to ensure that, if the pre-motor filter 48 is inserted back-to-front or upside down, the magnetic element 50 is spaced from the Hall sensor 44 at a distance which exceeds the pre-determined distance so that the Hall sensor 44 changes state when the pre-motor filter 48 is inserted incorrectly.

An airflow generator 52 is located downstream of the cavity 38. The airflow generator 52 takes the form of a motor and fan assembly and has an inlet 54 and an outlet 56. The inlet 54 communicates with the interior of the cavity 38. A post-motor filter 58 is located downstream of the outlet 56. The electronic circuit 46 is arranged selectively to allow or prevent operation of the airflow generator 52 depending upon the state of the Hall sensor 44. This in turn is dependent upon the separation between the Hall sensor 44 and the magnetic element 50.

In use, a user grips the handgrip 18 in order to manipulate the hand-held vacuum cleaner 10. When the user squeezes the trigger 20, the airflow generator 52 operates and draws a flow of dirt- and dust-laden air into the suction inlet 14, through the suction conduit 22 and into the cyclonic separating apparatus 14. Dirt- and dust-laden air enters the upstream cyclone 26 and larger dirt and dust particles are separated by cyclonic motion. These particles are then collected in the upstream cyclone 26.

The partially-cleaned airflow then enters the plurality of parallel downstream cyclones 28 which are able to separate further particles of dirt and dust from the partially-cleaned airflow. The cleaned air then exits the cyclonic separating apparatus 14 and passes sequentially through the cavity 38 (containing the pre-motor filter 48), the airflow generator 52, and the post-motor filter 58 before being exhausted from the vacuum cleaner 10 through the exhaust vents 30.

After a period of operation of the hand-held vacuum cleaner 10, the pre-motor filter 48 will require cleaning or replacement. In order to do this, the catch 36 is pressed to release the first and second lips 32, 34 from one another. The cyclonic separating apparatus 14 can then be separated from the remainder of the hand-held cleaning appliance 10 to reveal the cavity 38 in which the pre-motor filter 48 is located (see FIG. 2). The pre-motor filter 48 can then be removed for cleaning or replacement.

When the pre-motor filter 48 is removed from the cavity 38, the Hall sensor 44 will detect a reduction in the magnetic field of the magnetic element 50. When the magnetic field experienced by the Hall sensor 44 drops below the pre-determined value, the state of the Hall sensor 44 will change. The electronic circuit 46 detects the change of state of the Hall sensor 44 and prevents the airflow generator 52 from operating.

The airflow generator 52 will remain inoperative until the (or a new) pre-motor filter 48 is correctly inserted into the cavity 38. When this is done, the magnetic element 50 will be spaced from the Hall sensor 44 at a distance less than the pre-determined distance. Consequently, the state of the Hall sensor 44 will change and the airflow generator 52 will be allowed to operate.

When the pre-motor filter 48 is removed, the inlet 54 is exposed. If a finger or other object is inserted into the inlet 54 whilst the airflow generator 52 is operating, this may injure the user and damage the airflow generator 52. Therefore, an additional benefit of the present invention is that the airflow generator 52 cannot operate when the inlet 54 is exposed.

Variations will be apparent to the person skilled in the art. For example, the interlock may take a form other than a Hall sensor. A radio frequency (RF) emitter and detector may be used. The RF emitter may be an active component, e.g. comprising a power source to emit a signal, or it may be a passive component, e.g. an emitter which is charged by the electric or magnetic field of the detector or has a built-in emission field.

Alternatively, other forms of remote communication between the first and second parts of the interlock are possible. For example, infra-red or any other form of remote electromagnetic communication is possible.

Cyclonic separating apparatus need not be used. Other forms of separating apparatus could be used, for example, a porous bag. Further, the present invention is applicable to any type of filter or removable separating apparatus.

The cleaning appliance need not be a hand-held vacuum cleaner. The invention is applicable to other types of vacuum cleaner, for example, upright machines or cylinder machines. Further, the present invention is applicable to other types of cleaning appliances, for example, a wet and dry machine or a carpet shampooer.

The invention claimed is:

1. A cleaning appliance comprising:
a main body,
a filter, and
an interlock,
the main body including,
an airflow generator,
a separating apparatus for separating dirt and dust from an airflow, and
a flowpath between the separating apparatus and the airflow generator, the flowpath being delimited by a wall,
the filter being removably located in a pre-determined position in the flowpath, and
the interlock having a first part located on the filter and a second part located on the main body outside the flowpath, the first and second parts being configured to communicate remotely when the filter is correctly located in the pre-determined position, and
the interlock being configured selectively to allow or prevent operation of the airflow generator depending upon a relative separation between the first and second parts.

2. The cleaning appliance of claim 1, wherein the first and second parts are spaced from one another when the filter is correctly located in the pre-determined position.

3. The cleaning appliance of claim 1 or 2, wherein the separating apparatus is cyclonic separating apparatus.

4. The cleaning appliance of claim 1 or 2, wherein the filter has a longitudinal axis and a transverse axis, and the first part is spaced from at least one of the longitudinal and transverse axes.

5. The cleaning appliance of claim 4, wherein the first part is spaced from both the longitudinal axis and the transverse axis.

6. The cleaning appliance of claim 1 or 2, wherein the cleaning appliance is a vacuum cleaner.

7. The cleaning appliance of claim 6, wherein the cleaning appliance is a hand-held vacuum cleaner.

8. The cleaning appliance of claim 1 or 2, wherein the first part includes an emission source and the second part includes a detector.

9. The cleaning appliance of claim 8, wherein the first part includes a passive emission source.

10. The cleaning appliance of claim 8, wherein the first part is a magnetic element and the second part is a Hall sensor.

11. The cleaning appliance of claim 8, wherein the first part is an electromagnetic transmitter and the second part is an electromagnetic receiver.

12. The cleaning appliance of claim 11, wherein the first part is a radio frequency emitter and the second part is a radio frequency detector.

13. The cleaning appliance of claim 1 or 2, wherein the interlock is configured to prevent operation of the airflow generator when the separation between the first and second parts exceeds a pre-determined distance.

14. The cleaning appliance of claim 13, wherein the filter has a longitudinal axis and a transverse axis, and the first part is spaced from at least one of the longitudinal and transverse axes.

15. The cleaning appliance of claim 14, wherein the first part is spaced from both the longitudinal axis and the transverse axis.

16. The cleaning appliance claim 13, wherein the first part includes an emission source and the second part includes a detector.

17. The cleaning appliance of claim 16, wherein the first part includes a passive emission source.

* * * * *